US011109679B2

(12) United States Patent
Richard et al.

(10) Patent No.: US 11,109,679 B2
(45) Date of Patent: Sep. 7, 2021

(54) SHELVING ASSEMBLY AND HARDWARE

(71) Applicant: Clairson, Inc., Newark, DE (US)

(72) Inventors: Maxime Richard, Orlando, FL (US); Ryan Barclay Bishop, Ocala, FL (US)

(73) Assignee: Clairson, Inc., Newark, DE (US)

( * ) Notice: Subject to any disclaimer, the term of this patent is extended or adjusted under 35 U.S.C. 154(b) by 0 days.

(21) Appl. No.: 16/746,361

(22) Filed: Jan. 17, 2020

(65) Prior Publication Data

US 2020/0288866 A1 Sep. 17, 2020

Related U.S. Application Data

(60) Provisional application No. 62/806,360, filed on Feb. 15, 2019.

(51) Int. Cl.
*A47B 96/06* (2006.01)
*A47B 57/40* (2006.01)
*A47B 61/00* (2006.01)

(52) U.S. Cl.
CPC ..... *A47B 96/06* (2013.01); *A47B 57/40* (2013.01); *A47B 61/00* (2013.01)

(58) Field of Classification Search
CPC ..... A47B 96/06; A47B 57/40; A47B 61/00; A47B 96/061; A47B 96/066; A47B 96/068; A47B 96/07; A47B 96/027; A47B 96/14; A47B 96/1433; A47B 57/52; A47B 57/56; A47B 47/022; A47B 57/045; A47B 57/42; A47B 57/46; A47F 5/08; A47F 5/101; A47F 5/103; F16B 41/002; F16B 5/0258
USPC ..... 211/187, 87.01, 103, 193, 90.01, 90.02, 211/90.04; 248/235, 250; 411/999
See application file for complete search history.

(56) References Cited

U.S. PATENT DOCUMENTS 813,501 A * 2/1906 Keil ..... A47B 57/42 248/243
1,360,180 A * 11/1920 Congdon ..... H04M 1/11 248/300
1,495,889 A * 5/1924 Dambek ..... A47B 96/061 248/247
1,877,196 A * 9/1932 Parker ..... A47B 96/062 248/250
1,882,980 A * 10/1932 Schrader ..... A47H 1/14 248/250
1,893,729 A * 1/1933 Call ..... A47B 57/46 248/222.14
2,091,599 A * 8/1937 Larson ..... B60Q 3/43 224/29.5

(Continued)

*Primary Examiner* — Jennifer E. Novosad
(74) *Attorney, Agent, or Firm* — Brooks Kushman P.C.

(57) ABSTRACT

A shelving assembly includes a shelf bracket having a base and sidewalls extending upwardly from the base, wherein a cavity is defined between the base and the sidewalls. The sidewalls collectively form an upper edge, and the base includes at least one aperture. The shelving assembly further includes a fastener having a head and a shank extending therefrom with a distal end, and an anchor including a channel sized to receive the fastener, where the anchor is arranged to be received in the shelf bracket with the channel aligned with the at least one aperture. The anchor is capable of retaining the fastener in a preinstallation position with respect to the shelf bracket wherein the head is below the base and the distal end of the shank is disposed within the cavity beneath the upper edge.

25 Claims, 5 Drawing Sheets

(56) References Cited

U.S. PATENT DOCUMENTS 2,622,834 A * 12/1952 Sparring ..... A47B 57/42 248/243
2,653,783 A * 9/1953 Lindsay ..... A47B 57/42 248/243
2,681,786 A * 6/1954 Sparring ..... A47B 57/42 248/243
2,767,950 A * 10/1956 Bellon ..... F16B 41/002 248/243
2,883,137 A * 4/1959 Weber ..... A47B 57/045 248/243
2,997,269 A * 8/1961 Urbain ..... A47B 57/52 248/245
3,097,822 A * 7/1963 Attwood ..... A47B 96/061 248/250
3,220,363 A * 11/1965 Gingher ..... A47G 25/06 108/147.17
3,439,812 A * 4/1969 Nagelkirk ..... F16B 12/20 211/90.04
3,596,942 A * 8/1971 Zoebelein ..... F16B 12/22 403/230
3,702,591 A * 11/1972 Banse ..... A47F 5/08 108/31
3,916,477 A * 11/1975 Baker, Sr. ..... A47H 1/144 16/94 D
3,966,158 A * 6/1976 Boundy ..... A47B 57/42 248/243
4,720,069 A * 1/1988 Bessinger ..... A47B 96/061 211/90.01
4,733,843 A * 3/1988 Bessinger ..... A47K 1/08 108/152
4,736,918 A * 4/1988 Bessinger ..... A47B 96/065 108/152
4,736,919 A * 4/1988 Bessinger ..... A47K 1/08 108/152
4,753,405 A * 6/1988 Camilleri ..... A47B 96/061 108/134
4,895,331 A * 1/1990 Nehls ..... A47B 57/565 108/108
5,197,703 A * 3/1993 Pratolongo ..... A47B 57/04 108/152
5,253,835 A * 10/1993 Herron, III ..... A47B 57/30 108/108
6,098,566 A * 8/2000 Metcalf ..... B63B 29/00 114/362
6,135,402 A * 10/2000 Hatano ..... F24F 1/62 248/205.1
6,138,584 A * 10/2000 Waite ..... A47B 96/028 108/108
6,202,966 B1 * 3/2001 MacDonald ..... A47B 57/425 248/243
6,345,579 B1 * 2/2002 Zaturensky ..... A47B 96/028 108/108
6,776,466 B2 * 8/2004 Harvie, III ..... A47B 96/061 108/108
6,851,653 B2 * 2/2005 Crowley ..... A47B 96/028 211/192
6,986,488 B2 * 1/2006 Migli ..... A47B 96/066 248/239
7,086,544 B1 * 8/2006 Doench ..... A47B 61/003 211/105.1
7,314,144 B2 * 1/2008 Stitchick ..... A47B 47/022 211/125
7,347,404 B2 * 3/2008 Anzai ..... A47B 96/065 108/152
7,726,615 B2 * 6/2010 Rutz ..... A47B 96/028 248/250
8,511,240 B1 * 8/2013 Strock ..... A47B 96/065 108/98
8,919,715 B2 * 12/2014 Terada ..... A47B 96/061 248/235
9,173,506 B2 * 11/2015 Andersson ..... A47B 57/485
9,867,464 B1 1/2018 Kokenge
10,098,460 B1 10/2018 Brinton, Jr.
2005/0045787 A1 * 3/2005 Magnusson ..... A47B 96/024 248/235
2007/0221597 A1 * 9/2007 Chen ..... A47B 96/028 211/192
2008/0217496 A1 * 9/2008 Wooten ..... A47B 96/061 248/248
2008/0272076 A1 * 11/2008 Davenport ..... A47B 57/42 211/90.01
2009/0139943 A1 * 6/2009 Fernandez ..... A47B 57/42 211/94.01
2012/0273447 A1 * 11/2012 Stitchick ..... A47B 96/06 211/90.01
2013/0214108 A1 * 8/2013 Irudayaraj ..... A47B 96/061 248/250
2014/0027589 A1 * 1/2014 Durgin ..... A47B 96/06 248/218.4
2015/0335155 A1 * 11/2015 Winker ..... A47B 96/061 211/90.02
2016/0100685 A1 * 4/2016 Tibbe ..... A47B 96/061 248/218.4
2019/0038023 A1 * 2/2019 Stocker ..... A47F 5/0093
2019/0085886 A1 * 3/2019 Davis ..... F16B 12/22
2019/0239647 A1 * 8/2019 Newman ..... A47B 96/061
2020/0288866 A1 * 9/2020 Richard ..... A47B 57/42

* cited by examiner

SHELVING ASSEMBLY AND HARDWARE

CROSS-REFERENCE TO RELATED APPLICATIONS

This application claims the benefit of U.S. provisional application Ser. No. 62/806,360 filed Feb. 15, 2019, the disclosure of which is hereby incorporated in its entirety by reference herein.

TECHNICAL FIELD

Various embodiments relate to shelving assemblies, storage systems with shelving assemblies, and bracketry.

BACKGROUND

The prior art has provided shelving assemblies, storage systems, and storage systems with shelving assemblies that include upright rails for mounting to an upright support surface and/or shelf brackets installed into an upright support surface.

SUMMARY

In one or more embodiments, a shelving assembly includes a shelf bracket having a base and sidewalls extending upwardly from the base, wherein a cavity is defined between the base and the sidewalls. The sidewalls collectively form an upper edge, and the base includes at least one aperture. The shelving assembly further includes a fastener having a head and a shank extending therefrom with a distal end, and an anchor including a channel sized to receive the fastener, where the anchor is arranged to be received in the shelf bracket with the channel aligned with the at least one aperture. The anchor is capable of retaining the fastener in a preinstallation position with respect to the shelf bracket wherein the head is below the base and the distal end of the shank is disposed within the cavity beneath the upper edge.

In one or more embodiments, a storage system includes an upright rail arranged to be attached to an upright support surface. A shelf bracket is arranged to be attached to the upright rail, the shelf bracket having a base and sidewalls extending upwardly from the base, wherein a cavity is defined between the base and the sidewalls. The sidewalls collectively form an upper edge, and the base includes at least one aperture. The storage system further includes a fastener having a head and a shank extending therefrom with a distal end, and an anchor including a channel sized to receive the fastener, where the anchor is arranged to be received in the shelf bracket with the channel aligned with the at least one aperture. The anchor is capable of retaining the fastener in a preinstallation position with respect to the shelf bracket wherein the head is below the base and the distal end of the shank is disposed within the cavity beneath the upper edge. A shelf is received on the upper edge of the shelf bracket, wherein the shelf bracket is arranged to be mounted to the shelf by moving the fastener from the preinstallation position to an installed position where the distal end of the shank extends above the upper edge to engage the shelf.

In one or more embodiments, a method for installing a shelving assembly includes providing a shelf, providing a shelf bracket having a base and sidewalls extending upwardly from the base, wherein a cavity is defined between the base and the sidewalls, the sidewalls collectively form an upper edge, and the base includes at least one aperture. The method further includes providing a fastener having a head and a shank extending therefrom with a distal end, providing an anchor including a channel sized to receive the fastener, inserting the anchor in the shelf bracket with the channel aligned with the at least one aperture, and inserting the fastener into the channel. The anchor retains the fastener in a preinstallation position with respect to the shelf bracket wherein the head is below the base and the distal end of the shank is disposed within the cavity beneath the upper edge. The method further includes installing the shelf by placing the shelf on the upper edge of the shelf bracket and moving the fastener from the preinstallation position to an installed position wherein the distal end of the shank extends above the upper edge to engage the shelf.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
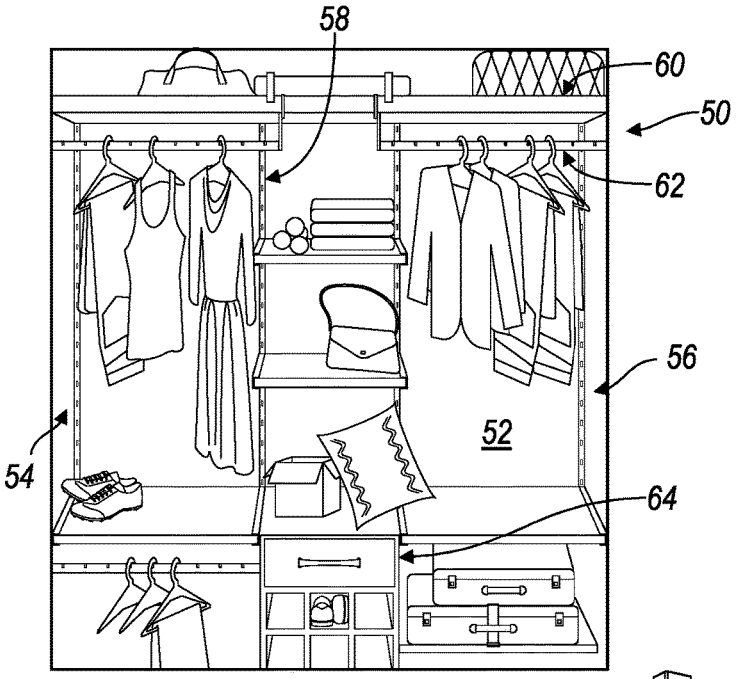
FIG. 1 is a perspective view of a storage system according to an embodiment.

FIG. 1 illustrates a storage system 50 according to an embodiment. In the depicted embodiment, the storage system 50 is installed in a closet, with an upright support surface, such as a central support wall 52, and a pair of side walls 54, 56. Although a closet environment is depicted, various environments with at least one wall can be utilized to install various storage systems, such as the embodiment 50 depicted in FIG. 1. For example, the storage system 50 may be employed in pantries, laundry rooms, garages, and the like.

The storage system 50 includes a plurality of upright rails 58, often referred to as standards 58. The standards 58 may be stamped or extruded metal rails that are fastened to the support wall 52 for attaching various subassemblies to the support wall 52. The storage system 50 is depicted with some assemblies, for example, shelving assemblies 60, clothing rod assemblies 62, drawer assemblies 64, and the like. Each of these various assemblies 60, 62, 64 are mounted to the standards 58.

Figure 2:
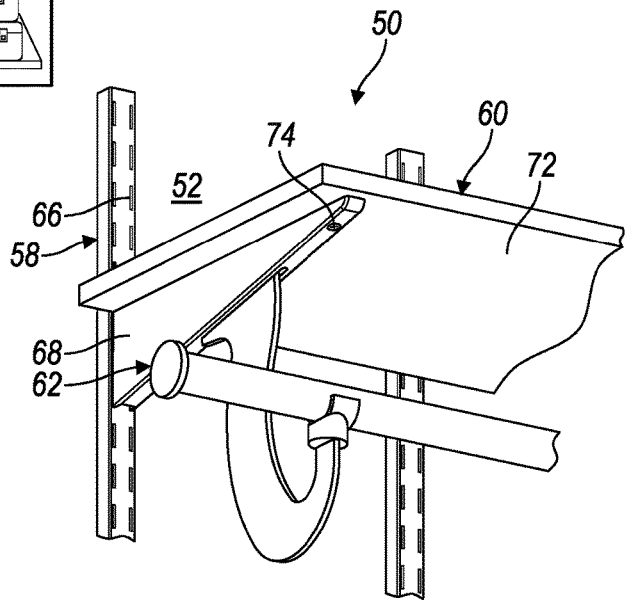
FIG. 2 is a perspective view of a shelving assembly and a clothing rod assembly of the storage system of FIG. 1, according to an embodiment.
Figure 3:
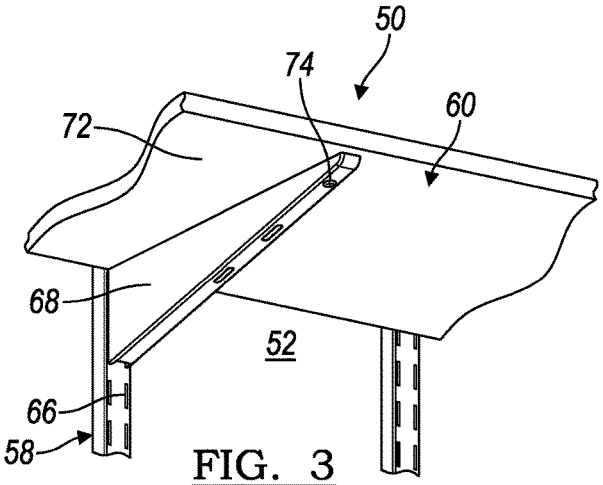
FIG. 3 is a perspective view of a shelving assembly of the storage system of FIG. 1, according to another embodiment.

FIG. 2 illustrates a shelving assembly 60 and a clothing rod assembly 62 of the storage system 50 according to an embodiment. FIG. 3 illustrates the shelving assembly 60 without the clothing rod assembly 62. The standards 58 have a depth to space apart from the wall 52. The standards 58 include a plurality of notches 66 formed therein, for example, in a linear array with two columns and multiple rows of notches 66 formed along the length of the standards 58.

The shelving assembly 60 includes a plurality of shelf brackets 68 installed into the notches 66 of the corresponding standard 58, wherein the shelf brackets 68 may include a plurality of hooks 70 (FIG. 12) sized to be received by the notches 66. A shelf 72 is supported upon the shelf brackets 68. The shelf 72 is fastened to the shelf brackets 68 by a plurality of fasteners, such as screws 74 received beneath the shelf bracket 68 and extending into an underside of the shelf 72. Prior art methods of installing the screws 74 into the shelf brackets 68 after the shelf 72 can be difficult and time-consuming to the installer, as described further below.

Figure 4:
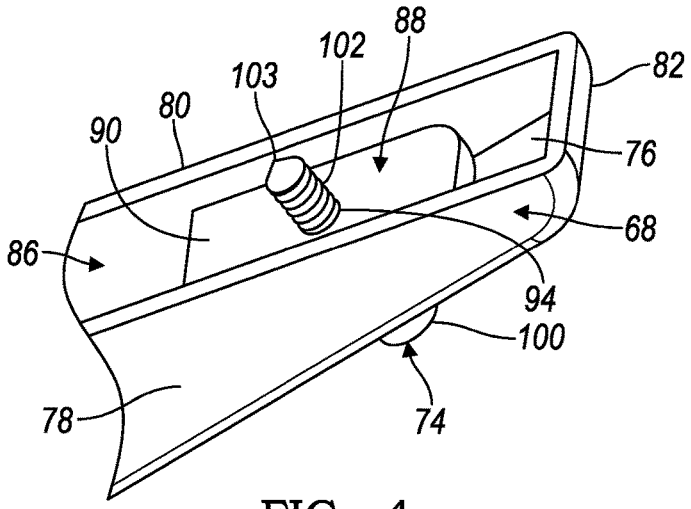
FIG. 4 is a top perspective view of the shelving assembly of FIG. 3, illustrated partially assembled.
Figure 5:
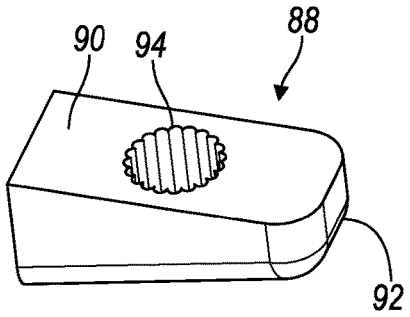
FIG. 5 is a top and left side perspective view of an insert anchor of the shelving assembly of FIG. 3.
Figure 8:
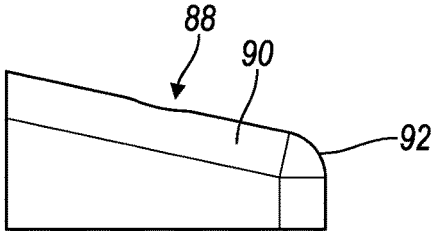
FIG. 8 is a right side elevation view of the insert anchor of FIG. 5.
Figure 9:
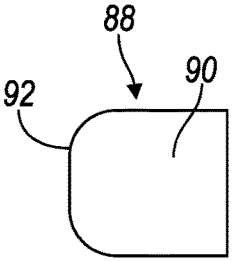
FIG. 9 is a rear side elevation view of the insert anchor of FIG. 5.
Figure 7:
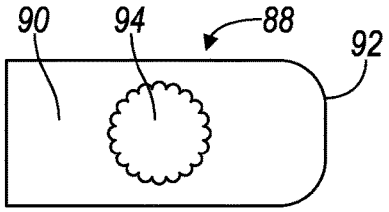
FIG. 7 is a top plan view of the insert anchor of FIG. 5.
Figure 10:
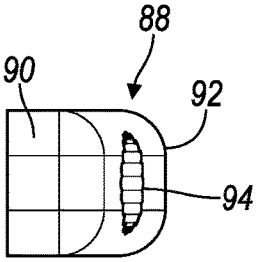
FIG. 10 is a front side elevation view of the insert anchor of FIG. 5.
Figure 6:
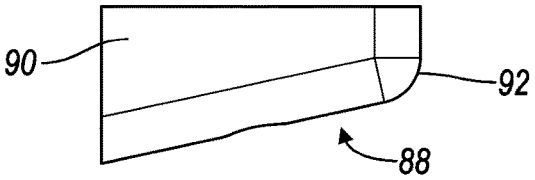
FIG. 6 is a left side elevation view of the insert anchor of FIG. 5.

Referring now to FIG. 4, the shelf bracket 68 may include a base 76 with sidewalls 78 extending upwardly therefrom. The sidewalls 78 collectively provide an upper edge 80 which has a width sized to contact and support the shelf 72. The sidewalls 78 also define a thickness of the shelf bracket 68. The sidewalls 78 may be tapered with a lesser height at a front end 82 thereof and a relatively greater height at a back end 84 thereof. A cavity 86 is defined between the base 76 and the sidewalls 78 and is formed to a depth and a width for the screw 74 to pass through the shelf bracket 68.

According to an embodiment, an insert anchor 88 may be received within the cavity 86. The insert anchor 88 is also illustrated in FIGS. 5-10. The insert anchor 88 may be formed from a polymeric material, such as nylon, or the like. The insert anchor 88 has a width sized to be received as a press-fit or an interference fit within the cavity 86 of the shelf bracket 68. The insert anchor 88 has a generally rectangular body 90 which may be tapered to correspond to an angle of the shelf bracket 68. The insert anchor 88 may also include rounded edges 92 to fit within rounded corners in the cavity 86 of the shelf bracket 68. The insert body 90 may be inserted between the sidewalls 78 and into the cavity 86 from above the base 76.

The insert anchor 88 includes a channel 94 formed therethrough to receive the screw 74, wherein the channel 94 may have a ribbed configuration to grip the screw 74. The insert anchor 88 may be installed in the shelf bracket 68 so that the channel 94 is aligned with a front aperture 96 (FIG. 12) in the shelf bracket 68. However, it is understood that the insert anchor 88 could also be configured for installation in the shelf bracket 68 aligned with a back aperture 98 (FIG. 12) of the shelf bracket 68 or that two insert anchors 88 could be provided, one for each of the front and back apertures 96, 98.

Advantageously, the insert anchor 88 and the screw 74 can be preinstalled or preloaded into the shelf bracket 68 during production, at a production location which is different from an installation location. Referring again to FIG. 4, the screw 74 includes a head 100 that is exposed externally from the shelf bracket 68. The screw 74 also includes a threaded shank 102 with a distal end 103 that extends from the head 100, and is installed to extend through the bracket aperture 96, through the aligned insert channel 94, and partially through the shelf bracket 68, held in place by the insert anchor 88. In the preinstallation position of FIG. 4, the shank 102 is not fully installed—the head 100 is below the base 76 of the shelf bracket 68 and the distal end 103 of the shank 102 does not extend past an upper edge 80 of the shelf bracket 68. This preinstallation position prevents the shank 102 from marring or damaging the shelf 72 during installation. Once the shelf 72 is in place upon the shelf brackets 68, the screws 74 may be driven to an installed position where the distal end 103 of the shank 102 extends above the upper edge 80, thereby engaging and fastening the shelf 72 to the shelf brackets 68. As the insert anchor 88 holds the screw 74 in position within the shelf bracket 68, the insert anchor 88 also serves as an alignment and stability tool, making it easier for the installer to drive the screw 74 to complete installation.

Figure 11:
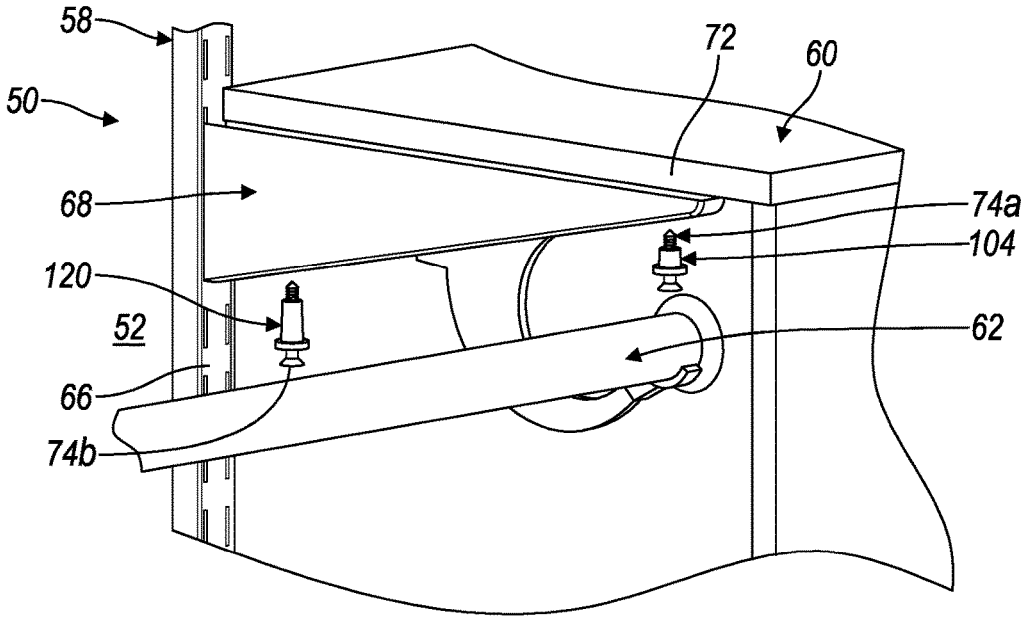
FIG. 11 is a perspective view of a shelving assembly and a clothing rod assembly of the storage system of FIG. 1, according to another embodiment.
Figure 12:
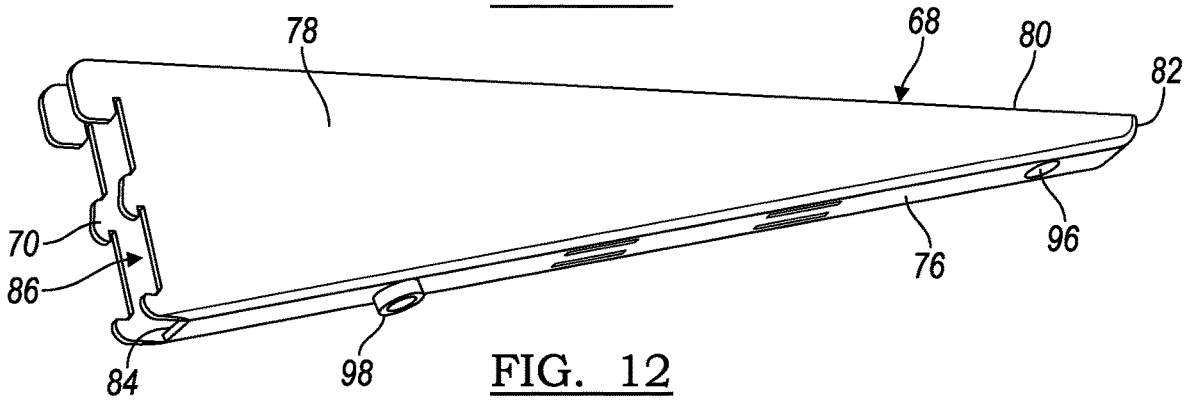
FIG. 12 is a front perspective view of a shelf bracket for the shelving assembly of FIG. 11.
Figure 13:
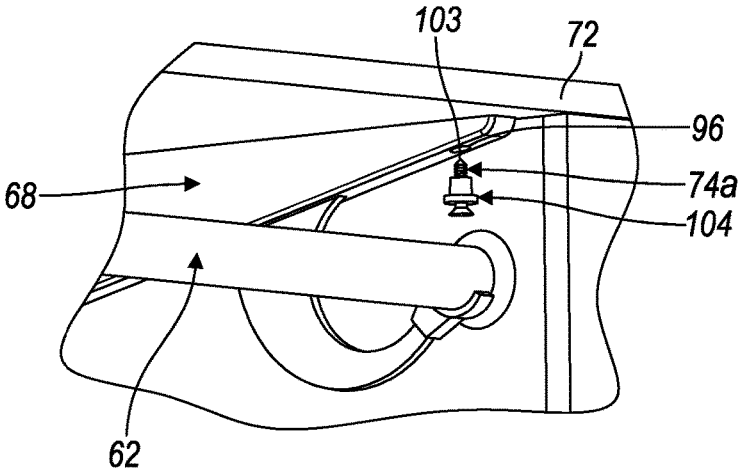
FIG. 13 is an enlarged perspective view of a front end of the shelving assembly of FIG. 11.
Figure 14:
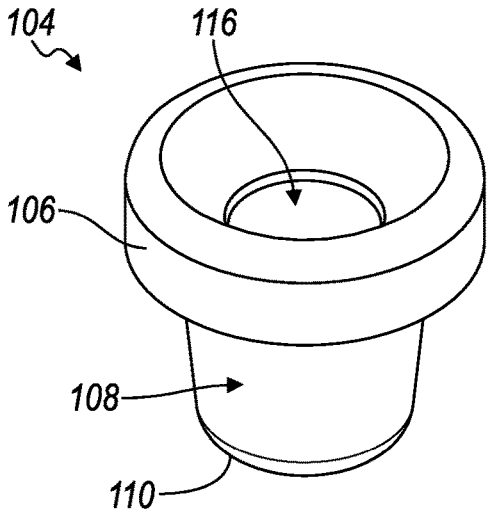
FIG. 14 is a perspective view of a front anchor according to an embodiment.

Turning now to FIGS. 11-13, a shelving assembly 60 of the storage system 50 are illustrated according to another embodiment. As with the previous embodiment (for example, FIG. 4), the shelving assembly 60 includes a plurality of shelf brackets 68 installed into the notches 66 of the corresponding standard 58, wherein the shelf brackets 68 may include a plurality of hooks 70 (FIG. 12) sized to be received by the notches 66. A shelf 72 is supported upon the shelf brackets 68. The shelf 72 is fastened to the shelf brackets 68 by a plurality of fasteners, such as screws 74 received beneath the shelf bracket 68 and extending into an underside of the shelf 72.

As shown in FIG. 12, the shelf bracket 68 may include a base 76 with sidewalls 78 extending upwardly therefrom. The sidewalls 78 collectively provide an upper edge 80 which has a width sized to contact and support the shelf 72. The sidewalls 78 also define a thickness of the shelf bracket 68. The sidewalls 78 may be tapered with a lesser height at a front end 82 thereof and a relatively greater height at a back end 84 thereof. A cavity 86 is defined between the base 76 and the sidewalls 78 and is formed to a depth and a width for the screw 74 to pass through the shelf bracket 68. In the embodiment depicted in FIG. 11, two screws 74 may be used to secure the shelf bracket 68 to the shelf 72, namely a front screw 74*a* and a back screw 74*b*. As shown, the back screw 74*b* may be longer than the front screw 74*a*.

Figure 15:
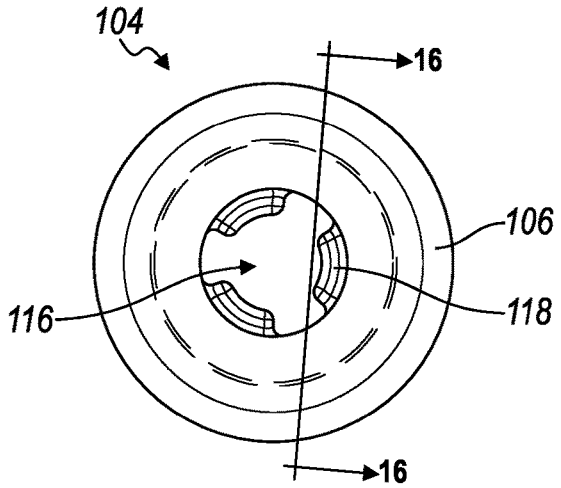
FIG. 15 is a top plan view of the front anchor of FIG. 14.
Figure 16:
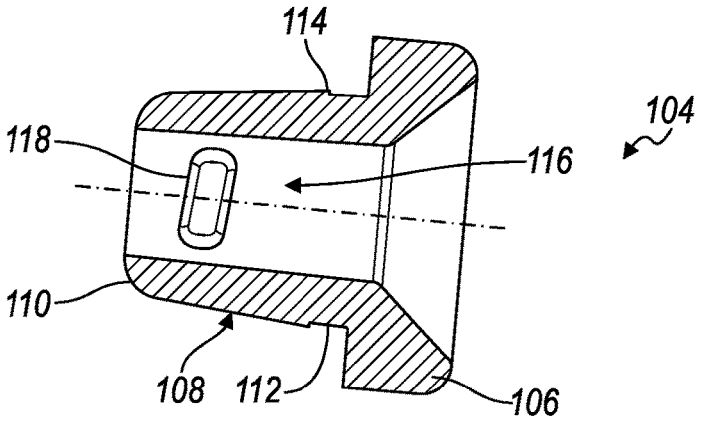
FIG. 16 is a cross-sectional view of the front anchor along line 16-16 in FIG. 15.
Figure 17:
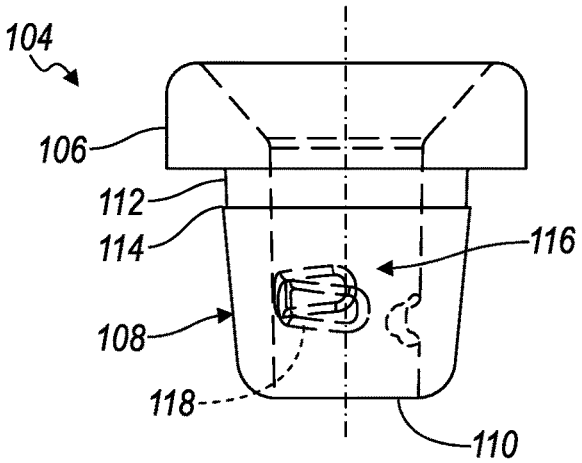
FIG. 17 is a front view of the front anchor of FIG. 14.

In order to aid installation of the shelf bracket 68, a front anchor 104 may be provided to receive the front screw 74*a*, as illustrated in FIGS. 11 and 13, and also in FIGS. 14-17. The front anchor 104 may include a head portion 106 and a shaft portion 108 extending therefrom. As shown, the head portion 106 may have a larger diameter than the shaft portion 108 and may be sized to receive the screw head 100 thereon or therein when the screw 74*a* is installed. The head portion 106 may also have a diameter larger than the aperture 96, 98. The shaft portion 108 has a diameter sized to be received as a press-fit or an interference fit through the front aperture 96 of the shelf bracket 68, wherein the shaft portion 108 may be tapered toward a distal end 110 thereof in order to facilitate insertion of the shaft portion 108 into the aperture 96. The distal end 110 may also be rounded to facilitate initial insertion into the aperture 96. The shaft portion 108 may include a recessed area 112 near the head portion 106 which defines a shoulder 114. When the shaft portion 108 is inserted into the aperture 96, the shoulder 114 may engage an interior of the base 76 and provide resistance to dislodging the front anchor 104 from the shelf bracket 68. Dimensions provided in FIGS. 15-17 are merely exemplary and are not intended to be limiting.

With continuing reference to FIGS. 14-17, the shaft portion 108 is hollow, defining a channel 116 therethrough sized to receive the screw 74*a*, wherein a length of the channel 116 is shorter than a length of screw shank 102. A plurality of ribs 118 may be provided protruding inwardly within the channel 116 to engage and hold the shank 102 when inserted. In the embodiment shown, three spaced ribs 118 are provided around a portion of the channel 116, such as generally near the distal end 110 of the shaft portion 108, although other locations and configurations of ribs 118 are also fully contemplated. The ribs 118 may also be oriented at an angle (e.g., relative to the distal end 110), such as to enhance engagement with the threaded shank 102.

The front anchor 104 and the screw 74*a* can be preinstalled or preloaded into the shelf bracket 68 at the time of production, at a production location different from an installation location. In one embodiment, the screw 74*a* is preloaded in the front anchor 104 so that the shank 102 extends at least partially through the channel 116 and is held in place, such as by the ribs 118. The screw 74*a* can be preloaded into the front anchor 104 either before or after the front anchor 104 is inserted into the front aperture 96 of the shelf bracket 68. In this preinstallation position of the front anchor 104 in the shelf bracket 68, the screw shank 102 is not fully installed—the screw head 100 is spaced from the head portion 106 of the front anchor 104 and below the base 76, and the distal end 103 of the shank 102 does not extend past the upper edge 80 of the shelf bracket 68. This preinstallation position prevents the shank 102 from marring or damaging the shelf 72 during installation. Once the shelf 72 is in place upon the shelf bracket 68, the screws 74 may be driven to an installed position wherein the distal end 103 of the shank 102 extends above the upper edge 80, thereby engaging and fastening the shelf 72 to the shelf bracket 68. As the front anchor 104 holds the screw 74*a* in position within the shelf bracket 68, the front anchor 104 also serves as an alignment and stability tool, making it easier for the installer to drive the screw 74*a* to complete installation.

The front anchor 104 may be constructed from a polymeric material, such as a polyketone, or any other suitable material. If the front anchor 104 is preinstalled in the shelf bracket 68 at the time of production, the material used for the front anchor 104 should be durable enough to withstand drop testing or other product testing standards. Alternatively, the front anchor 104 may be installed into the shelf bracket 68 during installation of the shelving assembly 60. While the front anchor 104 is described herein as being installed in the front aperture 96 of the shelf bracket 68, it is understood that the front anchor 104 could also be configured for installation in the back aperture 98 of the shelf bracket 68, or in both of the front and back apertures 96, 98.

In some instances, only a front screw 74*a* may be used or required to install the shelf bracket 68 to the shelf 72. However, in other cases, an additional back screw 74*b* may be installed into the back bracket aperture 98 if extra stability is desired or required. In one embodiment, instead of being preinstalled at the time of production, this back screw 74*b* may optionally added during installation.

Figure 18:
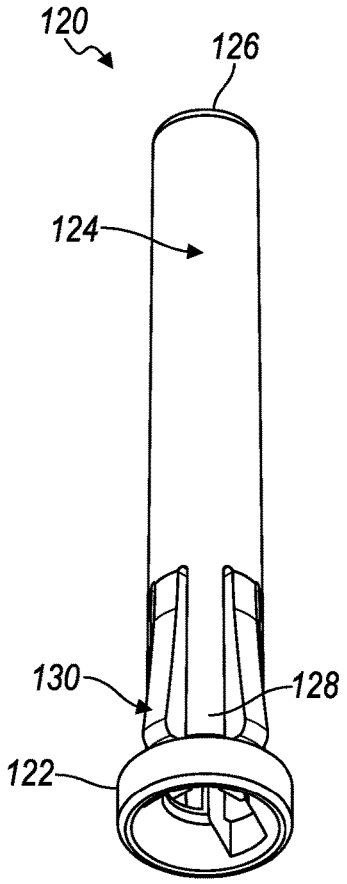
FIG. 18 is a perspective view of a back anchor according to an embodiment.
Figure 19:
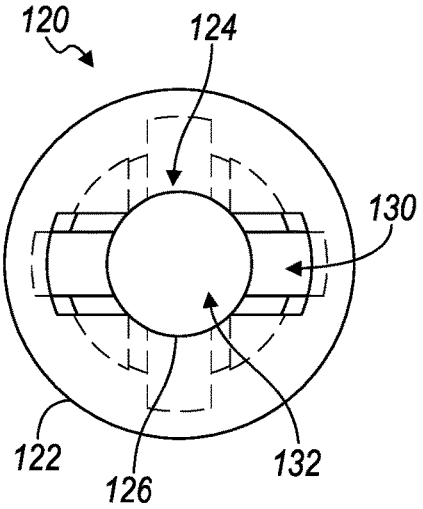
FIG. 19 is a bottom plan view of the back anchor of FIG. 18.
Figure 20:
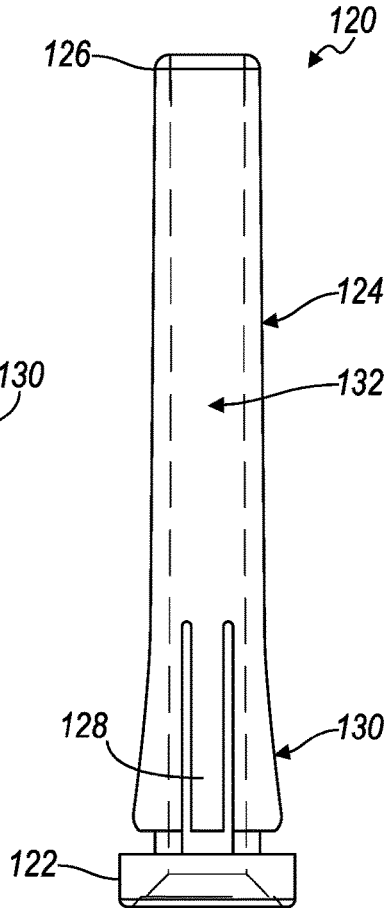
FIG. 20 is a front elevation view of the back anchor of FIG. 18.

Accordingly, a back anchor 120 may be provided to receive and aid installation of the back screw 74*b*, as illustrated in FIGS. 18-21. The back anchor 120 may be constructed from a polymeric material, such as an acetal copolymer, or any other suitable material. The back anchor 120 may include a head portion 122 and a shaft portion 124 extending therefrom. As shown, the head portion 122 may have a larger diameter than the shaft portion 124 and is sized to receive the screw head 100 thereon or therein when the screw 74*b* is installed. The head portion 106 may also have a diameter larger than the aperture 96, 98. Dimensions provided in FIGS. 19 and 20 are merely exemplary and are not intended to be limiting.

The shaft portion 124 has a diameter sized to be received through the back aperture 98 of the shelf bracket 68, wherein the shaft portion 124 may be tapered toward a distal end 126 thereof in order to facilitate insertion of the shaft portion 124 into the aperture 98. The distal end 126 may also be rounded to facilitate initial insertion into the aperture 98. A proximal end 128 of the shaft portion 124 may include a plurality of flexible, resilient arms 130 that protrude outwardly from the shaft portion 124 in a resting position, as illustrated in FIG. 18. When the shaft portion 124 is inserted into the aperture 98, the flexible arms 130 are compressed inward as they pass through the aperture 98, and then expand outwardly to engage an interior of the base 76 and provide resistance to dislodging the back anchor 120 from the shelf bracket 68.

With continuing reference to FIGS. 18-21, the shaft portion 124 is hollow, defining a channel 132 therethrough sized to receive the screw 74*b*, wherein a length of the channel 132 is shorter than a length of screw shank 102. With the back anchor 120 installed in the shelf bracket 68, the screw 74*b* may be inserted into the channel 132 of the back anchor 120 where the shank 102 will engage an interior of the flexible arms 130, causing the arms 130 deflect outwardly beyond their resting position. Due to the resilient bias of the arms 130 to return to their resting position, the arms 130 hold the shank 102 when the screw 74*b* is at least partially inserted into the back anchor 120.

Figure 21:
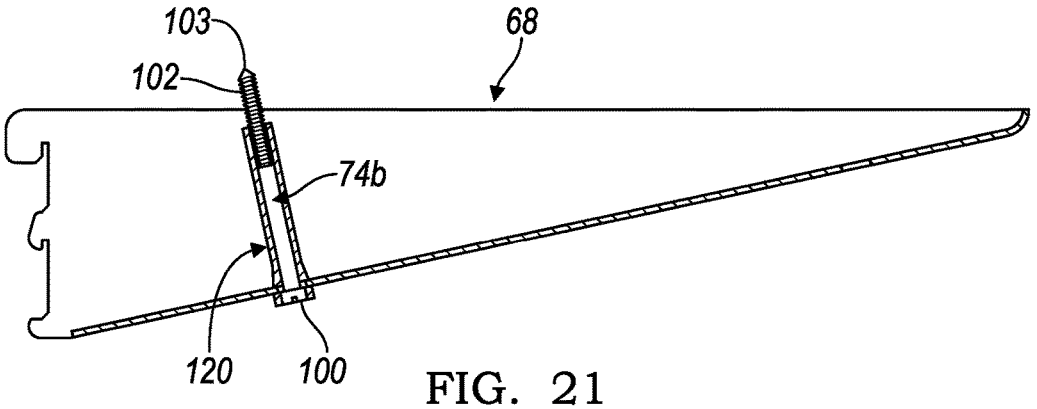
FIG. 21 is a cross-sectional view of the shelf bracket and installed back anchor.

According to an embodiment, the screw shank 102 is not fully installed in the back anchor 120, but rather in a preinstallation position where the screw head 100 is spaced from the head portion 122 of the back anchor 120 and the distal end 103 of the shank 102 does not extend past the upper edge 80 of the shelf bracket 68. The screw 74*b* can be maintained in this position until the installer is ready to drive the screw 74*b* to the fully installed position with the distal end 103 of the shank 102 extending above the upper edge 80, thereby engaging and fastening the shelf 72 to the shelf bracket 68, as shown in FIG. 21. As the back anchor 120 holds the screw 74*b* in position within the shelf bracket 68, the back anchor 120 also serves as an alignment and stability tool, making it easier for the installer to drive the screw 74*b* to complete installation. While the back anchor 120 is described herein as being installed in the back aperture 98 of the shelf bracket 68, it is understood that the back anchor 120 could also be configured for installation in the front aperture 96 of the shelf bracket 68, or in both of the front and back apertures 96, 98.

To install shelving assemblies 60, the installation of screws 74 occurs from below the base 76 of the shelf bracket 68. The embodiments disclosed herein permit positioning and retaining of the screws 74 in the shelf bracket 68 prior to full installation, preventing the screws 74 from falling out of the shelf bracket 68. Loading the screw 74 into the shelf bracket 68 prior to installation preemptively frees up hands of installers, reduces the lost time due to dropped screws, misaligned screws, fumbling through a belt pouch to get the screws and thread them through the apertures 96, 98 of the shelf bracket 68, or removing and reapplying work gloves. These efficiencies result in convenience to the end user as well as increased profits to installers. The efficiencies gained with the preinstalled screws 74 is magnified because storage systems 50 are often installed in multifamily housing sites. Each site often requires installations of dozens to hundreds of units, each with multiple closets and a laundry room, and each application requiring multiple shelf brackets 68 to be attached to a wall 52 with shelves 72.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A shelving assembly, comprising:

a shelf bracket having a base and sidewalls extending upwardly from the base, wherein a cavity is defined between the base and the sidewalls, the sidewalls collectively forming an upper edge, the base including at least one aperture;

a fastener having a head and a shank extending therefrom with a distal end; and an anchor including a channel sized to receive the fastener, the anchor removably receivable in the shelf bracket with the channel aligned with the at least one aperture, the anchor capable of retaining the fastener in a preinstallation position with respect to the shelf bracket wherein the head is below the base and the distal end of the shank is disposed within the cavity beneath the upper edge.

2. The shelving assembly of claim 1, further comprising a shelf arranged to be received on the upper edge of the shelf bracket, wherein the shelf bracket is arranged to be mounted to the shelf by moving the fastener from the preinstallation position to an installed position wherein the distal end of the shank extends above the upper edge to engage the shelf.

3. The shelving assembly of claim 1, wherein the anchor includes a plurality of ribs protruding inwardly within the channel arranged to engage and hold the shank of the fastener.

4. The shelving assembly of claim 1, wherein the anchor includes a head portion and a shaft portion extending therefrom, the shaft portion arranged to be received in the at least one aperture, wherein the head portion has a larger diameter than the shaft portion.

5. The shelving assembly of claim 4, wherein the shaft portion includes a recessed area near the head portion which defines a shoulder, wherein the shoulder is arranged to engage an interior of the base when the shaft portion is received in the at least one aperture to provide resistance to dislodging the anchor from the shelf bracket.

6. The shelving assembly of claim 4, wherein a proximal end of the shaft portion includes a plurality of flexible arms that protrude outwardly from the shaft portion to provide resistance to dislodging the anchor from the shelf bracket, wherein the flexible arms are arranged to engage and retain the shank of the fastener.

7. The shelving assembly of claim 1, wherein the anchor has a generally rectangular body arranged to be received within the cavity.

8. A storage system, comprising:

an upright rail arranged to be attached to an upright support surface;

a shelf bracket arranged to be attached to the upright rail, the shelf bracket having a base and sidewalls extending upwardly from the base, wherein a cavity is defined between the base and the sidewalls, the sidewalls collectively forming an upper edge, the base including at least one aperture;

a fastener having a head and a shank extending therefrom with a distal end;

an anchor including a channel sized to receive the fastener, the anchor removably receivable in the shelf bracket with the channel aligned with the at least one aperture, the anchor capable of retaining the fastener in a preinstallation position with respect to the shelf bracket wherein the head is below the base and the distal end of the shank is disposed within the cavity beneath the upper edge; and a shelf received on the upper edge of the shelf bracket, wherein the shelf bracket is arranged to be mounted to the shelf by moving the fastener from the preinstallation position to an installed position where the distal end of the shank extends above the upper edge to engage the shelf.

9. The storage system of claim 8, wherein the anchor includes a head portion and a shaft portion extending therefrom, the shaft portion arranged to be received in the at least one aperture, wherein the head portion has a larger diameter than the shaft portion.

10. The storage system of claim 9, wherein the shaft portion includes a recessed area near the head portion which defines a shoulder, wherein the shoulder is arranged to engage an interior of the base when the shaft portion is received in the at least one aperture to provide resistance to dislodging the anchor from the shelf bracket.

11. The storage system of claim 9, wherein a proximal end of the shaft portion includes a plurality of flexible arms that protrude outwardly from the shaft portion to provide resistance to dislodging the anchor from the shelf bracket, wherein the flexible arms are arranged to engage and retain the shank of the fastener.

12. The storage system of claim 8, wherein the anchor has a generally rectangular body arranged to be received within the cavity.

13. A method for installing a shelving assembly, comprising:

providing a shelf;

providing a shelf bracket having a base and sidewalls extending upwardly from the base, wherein a cavity is defined between the base and the sidewalls, the sidewalls collectively forming an upper edge, the base including at least one aperture;

providing a fastener having a head and a shank extending therefrom with a distal end;

providing an anchor including a channel sized to receive the fastener, the anchor removably receivable in the shelf bracket;

inserting the anchor in the shelf bracket with the channel aligned with the at least one aperture;

inserting the fastener into the channel, the anchor retaining the fastener in a preinstallation position with respect to the shelf bracket wherein the head is below the base and the distal end of the shank is disposed within the cavity beneath the upper edge; and installing the shelf by placing the shelf on the upper edge of the shelf bracket and moving the fastener from the preinstallation position to an installed position wherein the distal end of the shank extends above the upper edge to engage the shelf.

14. The method of claim 13, wherein providing the shelf bracket includes preloading the anchor and the fastener into the shelf bracket in the preinstallation position during production at a production location different from an installation location.

15. The method of claim 13, further comprising installing the shelf bracket upon an upright support surface.

16. The method of claim 15, wherein installing the shelf bracket includes providing an upright rail, installing the upright rail upon the upright support surface, and attaching the shelf bracket to the upright rail.

17. The method of claim 13, wherein inserting the anchor includes providing the anchor with a head portion and a shaft portion extending therefrom and inserting the shaft portion in the at least one aperture from below the base.

18. The method of claim 17, wherein inserting the anchor includes providing the anchor with a plurality of flexible arms at a proximal end of the shaft portion that protrude outwardly from the shaft portion to provide resistance to dislodging the anchor from the shelf bracket.

19. The method of claim 13, wherein inserting the anchor includes providing the anchor with a generally rectangular body and inserting the body between the sidewalls and into the cavity from above the base.

20. A shelving assembly, comprising:

a shelf bracket having a base and sidewalls extending upwardly from the base, wherein a cavity is defined between the base and the sidewalls, the sidewalls collectively forming an upper edge, the base including at least one aperture;

a fastener having a head and a shank extending therefrom with a distal end; and an anchor including a channel sized to receive the fastener, the anchor arranged to be received in the at least one aperture, the anchor capable of retaining the fastener in a preinstallation position with respect to the shelf bracket wherein the head is below the base and the distal end of the shank is disposed within the cavity beneath the upper edge.

21. The shelving assembly of claim 20, further comprising a shelf arranged to be received on the upper edge of the shelf bracket, wherein the shelf bracket is arranged to be mounted to the shelf by moving the fastener from the preinstallation position to an installed position wherein the distal end of the shank extends above the upper edge to engage the shelf.

22. The shelving assembly of claim 20, wherein the anchor includes a plurality of ribs protruding inwardly within the channel arranged to engage and hold the shank of the fastener.

23. The shelving assembly of claim 20, wherein the anchor includes a head portion and a shaft portion extending therefrom, the shaft portion arranged to be received in the at least one aperture, wherein the head portion has a larger diameter than the shaft portion.

24. The shelving assembly of claim 23, wherein the shaft portion includes a recessed area near the head portion which defines a shoulder, wherein the shoulder is arranged to engage an interior of the base when the shaft portion is received in the at least one aperture to provide resistance to dislodging the anchor from the shelf bracket.

25. The shelving assembly of claim 23, wherein a proximal end of the shaft portion includes a plurality of flexible arms that protrude outwardly from the shaft portion to provide resistance to dislodging the anchor from the shelf bracket, wherein the flexible arms are arranged to engage and retain the shank of the fastener.

* * * * *